United States Patent [19]

Pejouhy

[11] 4,114,127

[45] Sep. 12, 1978

[54] CURRENT INTERRUPTING APPARATUS

[75] Inventor: Radi Pejouhy, Marshfield, Mass.

[73] Assignee: Texas Instruments Incorporated, Dallas, Tex.

[21] Appl. No.: 728,350

[22] Filed: Sep. 30, 1976

[51] Int. Cl.[2] ..... H01H 61/00

[52] U.S. Cl. ..... 337/97; 200/144 B; 335/151

[58] Field of Search ..... 200/144 B; 313/226; 337/112, 97; 335/151, 154

[56] References Cited

U.S. PATENT DOCUMENTS

| | | | |
|---|---|---|---|
| 1,481,422 | 1/1924 | Holst et al. | 313/226 |
| 2,060,235 | 11/1936 | Miller | 200/144 B |
| 3,621,568 | 11/1971 | D'Entremont et al. | 337/112 |

*Primary Examiner*—Harold Broome

*Attorney, Agent, or Firm*—John A. Haug; James P. McAndrews

[57] ABSTRACT

A current interrupting device having improved contact life incorporates a thermostatic member adapted to cause electrical contacts to move into and out of engagement depending on the temperature of the thermostatic member. The device is evacuated and back-filled with a mixture of argon and helium and then hermetically sealed.

3 Claims, 2 Drawing Figures

CURRENT INTERRUPTING APPARATUS

This invention relates to current interrupting devices and more particularly to such devices which are hermetically sealed.

Devices which incorporate thermostatic members, such as for example snap acting bimetallic elements, are conventionally used to interrupt circuits upon an overload, both thermal and current. The use of such devices is mandated in many cases by safety codes to protect various equipment, prevent overheating which may result in fire and other deleterious results. It is very important that such devices have a long life since once a device fails the equipment it protects will either be subject to damage upon an overload or will be shut down until the device is replaced. Various attempts have been made to enhance contact life, and concommittantly device life. Backfilling of thermostatic devices with various gases is one such way to improve contact life as well as to effect heat transfer in a particular manner. For instance U.S. Pat. No. 3,278,706 discloses the use of a mixture of helium and freon in an encapsulated snap acting thermostatic glass enveloped switch designed for use in an ambient temperature detecting and current sensitive device in connection with the operation of electrical equipment, such as motors. U.S. Pat. No. 3,278,705 discloses filling of a similar glass enveloped switch with helium, hydrogen, nitrogen or dry air to provide for heat transfer from the switch assembly, to improve contact insulation when the contacts are open and to eliminate moisture and other contaminants. With regard to the above gases nitrogen and dry air are relatively inexpensive and readily available however with the tendency in industry today of optimizing the utilization of equipment to the greatest possible extent it has been found that the longevity of the thermostatic switches with high current densities is not satisfactory. The other gases mentioned are either too expensive, do not result in the desired improvement in contact life or have some other undesirable characteristic.

It is therefore an object of the invention to provide a circuit interrupting device having improved contact life. Another object is the provision of a backfilling medium for a bimetallic snap acting hermetically sealed switch which is inexpensive, has desirable heat transfer and dielectric characteristics. Other objects will be in part apparent and in part pointed out hereinafter.

The invention accordingly comprises the elements and combinations of elements, features of construction, and arrangements of parts which will be exemplified in the structures hereinafter described, and the scope of the application of which will be indicated in the following claims.

Figure 1:
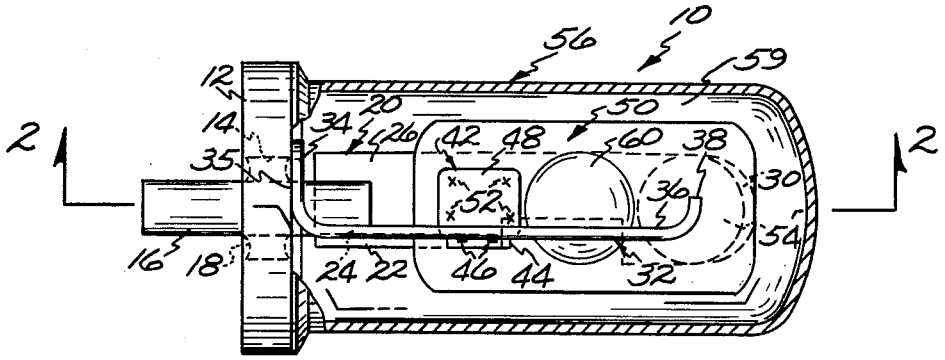
Figure 2:
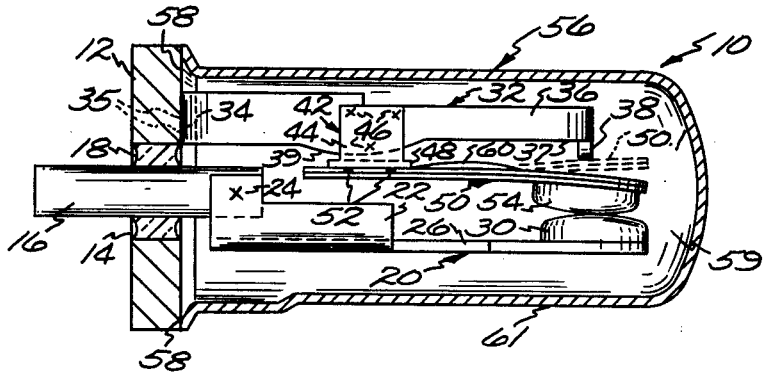

In the accompanying drawing, in which one of the various possible embodiments of the invention is illustrated:

FIG. 1 is a sectional view along the longitudinal axis of a thermostatic switch useful with this invention; and FIG. 2 is a sectional view along line 2—2 of FIG. 1.

Dimensions of certain of the parts as shown in the drawing may have been modified or exaggerated for the purpose of clarity of illustration.

Briefly the invention comprises backfilling an hermetically sealed thermostatic switch in order to improve contact life with a mixture of from 80–95 parts argon and 20–5 parts helium at a pressure of approximately from 0.75 to 2 atmospheres.

Referring to the drawings, numeral 10 indicates the novel and improved thermostatic switch of this invention which is shown to include a generally disc-shaped header plate or member 12 having central aperture 14 and having a terminal post 16 secured in the plate aperture in insulated relation to the plate by means of a sealant material 18. The header plate and terminal post are preferably formed of a rigid, electrically conductive material such as steel or the like. The rod is mounted in sealed, electrically insulated relation to the header plate by use of a glass sealant material 18 or other conventional electrically insulating material. As the terminal post is mounted in the header plate in the described manner by any well-known technique, sealing of the terminal post and the header plate is not further described herein.

As shown, the motor protector 10 further includes a rigid electrically conductive contact arm 20 formed of steel or the like, the arm including one flange portion 22 which is welded to one side of the terminal post 16 as indicated at 24 in FIG. 2 and including an angularly disposed flange portion 26 which extends in cantilever relation from the post 16 in a plane generally parallel to the terminal post 16. A fixed contact 30, preferably formed of high electrically conductive material such as silver, is welded or otherwise secured to the distal free end of the extending portion of the contact arm as shown.

The thermostatic switch 10 further includes a heater element or member 32 having one flange portion 34 welded to the header plate 12 as indicated at 35 and having a second flange 36 extending in cantilever relation from the header plate so that an edge 37 of the extending flange faces the terminal post 16. The heater element preferably includes a stop or end portion 38 which terminates in a plane lying parallel to the axis of the terminal post 16. The heater element also preferably has a rounded surface 39 formed on the edge 37 of the flange 36 as shown in FIG. 2. The heater element is formed of any one of a variety of materials of selected electrical conductivity so that the element is adapted to generate a predetermined amount of heat in response to selected flow of electrical current through the element. For example, the heater element may be formed of rigid cold rolled steel to provide the element with selected electrical heating characteristics.

In addition, the thermostatic switch 10 includes an electrically conductive, angle-shaped support 42 of cold rolled steel or the like which has one flange 44 welded to the heater element flange 36 as indicated at 46 in FIG. 2 and another flange 48 welded to an electrically conductive, resilient, thermal responsive snap acting member 50 as indicated at 52 in FIG. 1. A movable contact 54, preferably formed of the same material as the fixed contact 30, is welded or otherwise secured to the thermally responsive member oppositely of the support 42. As illustrated, the flange portion 44 of the support extends away from the thermally responsive member at substantially a right angle to the general plane of the member. The welding of the support 42 to the heater 32 disposes the thermally responsive member 50 in selected heat transfer relation to the heater element and locates the member 50 extended in cantilever relation from the heater so that the movable contact 54 engages and disengages the fixed contact 30 in response to snap acting movement of the member 50. That is, the member 50 is normally located as illustrated in solid lines in FIG. 2 so that the member resiliently holds the movable contact in engagement with the fixed contact to close the circuit from the header plate 12 to the heater 32, support 42, snap acting member 50, contacts 54 and 30, and contact arm 20 to the terminal post 16.

The thermally responsive snap acting element 50 is formed from a strip-shaped blank of bimetallic material which embodies two or more layers of metal bonded together, the metals being characterized by relatively high and low coefficients of thermal expansion respectively so that the strip tends to flex in response to temperature change. The movable contact 54 is welded or otherwise secured to one end of the strip. The strip is deformed in conventional manner to provide a dish-shaped portion 60 thereby to form a snap-acting member 50 of selected thermal response characteristics. As methods for deforming such bimetallic materials to form thermally responsive snap-acting elements having precisely controlled thermal response characteristics are well known, the deformation of the strip is not further described herein.

In assembling the switch the terminal post 16 is mounted in sealed electrically insulated relation within the header plate aperture in conventional manner as shown. The heater element 32 is then welded to the header plate as indicated at 35 and the support flange 44 and flange 36 of the heater are welded at 46. The fixed contact 30 is welded or otherwise secured to the contact arm 20 and the arm flange 22 is welded to the terminal post 16 as indicated at 24 to maintain the fixed immovable contact in desired relationship.

A cup-shaped body 56 formed of steel or other rigid material has its rim welded in electrically conductive relation to the header plate 12 as indicated at 58 to form a device chamber 59, this weld serving to seal the device chamber so that the thermostatic switch 10 is completely sealed and pressure resistant.

The device is evacuated and backfilled in any convenient way as by taking the header plate 12 with the heater element 32, snap-acting member 50 and contact arm 20 already attached thereto and placing this assembly in an area in which the environment can be controlled as in an evacuation chamber, the air is evacuated and replaced with a desired backfill gas as set forth in greater detail below and the cup-shaped body 56 is then hermetically secured to header plate 12.

When switch 10 is interposed in an electric motor circuit, current flow through the heater element 32 of the thermostatic switch does not normally generate sufficient heat to cause movement of the thermally responsive member 50 so that the switch circuit remains closed. However, when abnormal current flows in the motor circuit, increased current flow through the heater element 32 generates sufficient heat to cause the snap-acting member 50 to move with a snap action to the position indicated by dotted lines 50.1 in FIG. 2 to disengage the contacts 54 and 30 and to open the described switch circuit. In this open circuit position, the snap-acting member 50 resiliently engages stop portion 38 of the heater element for limiting travel of the member away from the fixed contact and for preventing undesirable movement of the member in response to vibration and the like.

Further details for the construction, calibration and operation of a switch as shown in the drawings may be found in U.S. Pat. No. 3,621,568 assigned to the assignee of the instant invention.

It has been found that when a mixture of argon and helium is used for backfilling of switch 10 a marked improvement in contact life is obtained, particularly in switches having contacts subjected to high current densities. A range of from 80–95 parts argon with the remainder of 20–5 parts helium is suitable while a specific mixture of 90 parts argon and 10 parts helium is preferable. Not only does the above mixture result in extended contact life, its thermal transfer characteristics are very close to nitrogen so that the ratings of devices in which nitrogen, dry air or the mixture in accordance with the invention need not be changed. This is a significant advantage since nitrogen and dry air were heretofore widely used. It has also been found that the above mixture is most effective at a pressure approximately from 0.75 to 2 atmospheres, absolute.

It will be apparent to those skilled in the art that the invention can be used with switches other than the type shown in the drawing as long as the switch is hermetically sealed. For example a multiphase switch in which several sets of contacts are employed or a switch in which the housing is of material other than metal such as glass in which terminal 20 could extend through the header assembly.

As various changes could be made in the above construction without departing from the scope of the invention, it is intended that all matter contained in the above description or shown in the accompanying drawing shall be interpreted as illustrative and not in a limiting sense.

In view of the above, it will be seen that the several objects of the invention are achieved and other advantageous results attained.

I claim:

1. Current interrupting apparatus comprising a housing having an open end, a thermostatic member mounted in the housing, the thermostatic member adapted for movement between first and second positions, movable and stationary contact means mounted within the housing, the movable contact operatively connected to the thermostatic member so that the contacts will be in engagement when the thermostatic member is in the first position and will be out of engagement when the thermostatic member is in the second position, electrical terminals electrically connected to the respective movable and stationary contact means, and an electrically insulative header closing the open end of the housing and maintaining the terminals electrically separated from one another and an atmosphere within the housing essentially consisting of a mixture of argon and helium in which the mixture consists of from 80–95 parts argon and 20–5 parts helium.

2. Apparatus according to claim 1 in which the mixture consists of 90 parts argon and 10 parts helium.

3. Apparatus according to claim 1 in which the atmosphere is under a pressure of from 0.75 to 2 atmospheres, absolute.

* * * * *